US012723216B2

(12) United States Patent
Engelman et al.

(10) Patent No.: US 12,723,216 B2
(45) Date of Patent: Sep. 1, 2026

(54) LUBRICANT ADDITIVES FOR PERFORMANCE BOOSTING

(71) Applicant: Afton Chemical Corporation, Richmond, VA (US)

(72) Inventors: Kristi Engelman, Richmond, VA (US); Amy M. James, Glen Allen, VA (US); John Atherton, Montpelier, VA (US); Gregory Guinther, Richmond, VA (US)

(73) Assignee: Afton Chemical Corporation

( * ) Notice: Subject to any disclaimer, the term of this patent is extended or adjusted under 35 U.S.C. 154(b) by 0 days.

(21) Appl. No.: 18/733,346

(22) Filed: Jun. 4, 2024

(65) Prior Publication Data

US 2025/0002805 A1 Jan. 2, 2025

Related U.S. Application Data

(60) Provisional application No. 63/509,813, filed on Jun. 23, 2023.

(51) Int. Cl.

| | |
|---|---|
| ***C10M 169/04*** | (2006.01) |
| ***C10M 133/12*** | (2006.01) |
| ***C10M 135/10*** | (2006.01) |
| ***C10M 159/12*** | (2006.01) |
| *C10N 30/00* | (2006.01) |
| *C10N 30/04* | (2006.01) |
| *C10N 30/10* | (2006.01) |

(Continued)

(52) U.S. Cl.

CPC ..... *C10M 169/04* (2013.01); *C10M 133/12* (2013.01); *C10M 135/10* (2013.01); *C10M 159/12* (2013.01); *C10M 169/045* (2013.01); *C10M 2203/003* (2013.01); *C10M 2215/26* (2013.01); *C10M 2219/046* (2013.01); *C10N 2030/041* (2020.05); *C10N 2030/10* (2013.01); *C10N 2030/52* (2020.05); *C10N 2040/04* (2013.01); *C10N 2040/25* (2013.01)

(58) Field of Classification Search

CPC ..... C10N 2030/04; C10N 2030/10; C10N 2040/04; C10N 2030/52; C10N 2010/04; C10N 2030/12; C10N 2040/25; C10N 2030/041; C10M 135/10; C10M 159/12; C10M 169/045; C10M 133/00; C10M 133/12; C10M 169/04; C10M 2215/064; C10M 2215/086; C10M 2203/003; C10M 2203/1006; C10M 2219/046; C10M 2215/28; C10M 2215/26; C10M 2207/10

See application file for complete search history.

(56) References Cited

U.S. PATENT DOCUMENTS 9,376,645 B2 * 6/2016 Yaguchi ..... C10M 141/08
2012/0135901 A1 5/2012 Shaw et al.

(Continued)

OTHER PUBLICATIONS

International Search Report and Written Opinion for PCT/US2024/034262, mailed Oct. 30, 2024.

*Primary Examiner* — Vishal V Vasisth
(74) *Attorney, Agent, or Firm* — Honigman LLP

(57) ABSTRACT

The present disclosure relates to booster additive packages and lubricating oil compositions including the booster additive packages improved deposits, sludge, wear, TBN retention, and/or rust protection. The booster additive package includes at least one or more oil soluble nitrogen-containing compounds and one or more detergent additives.

20 Claims, 1 Drawing Sheet

(51) Int. Cl.
*C10N 40/04* (2006.01)
*C10N 40/25* (2006.01)

(56) References Cited

U.S. PATENT DOCUMENTS

| | | | | |
|---|---|---|---|---|
| 2017/0121627 | A1 | 5/2017 | Ishikawa et al. | |
| 2018/0201859 | A1* | 7/2018 | Carpentier | C10M 135/10 |
| 2018/0237722 | A1 | 8/2018 | Burns, III et al. | |
| 2019/0330555 | A1* | 10/2019 | Yang | C10M 163/00 |
| 2022/0064560 | A1* | 3/2022 | Nakazawa | C10M 149/22 |

* cited by examiner

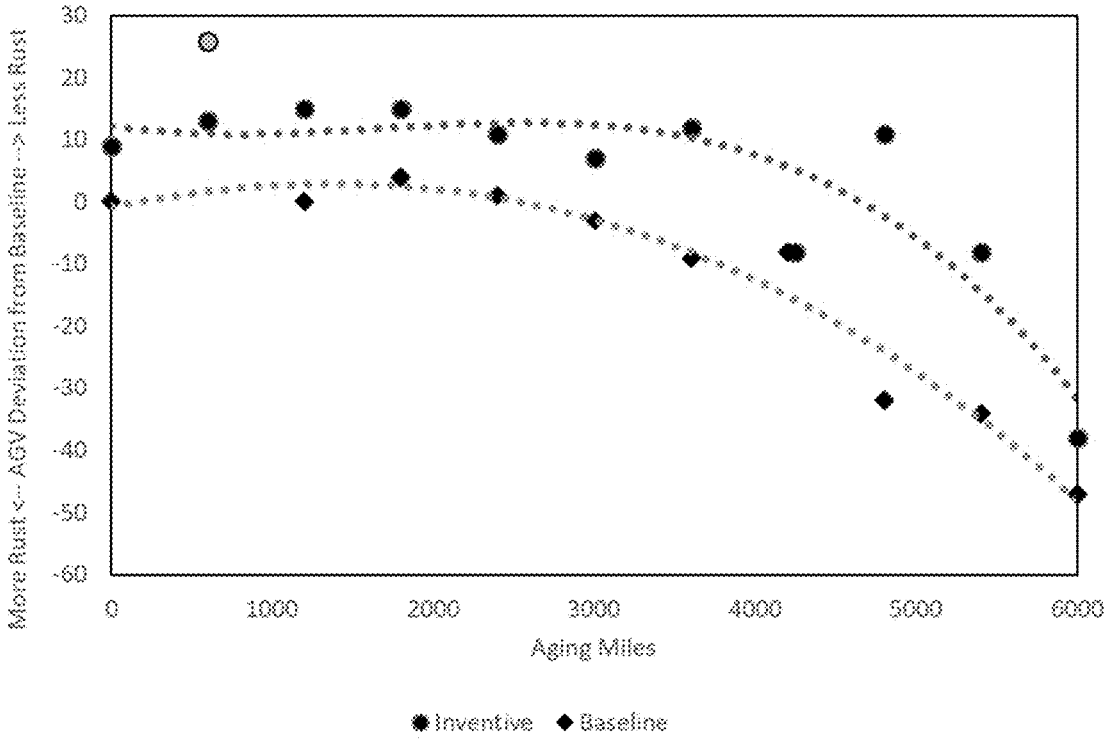
More Rust <-- AGV Deviation from Baseline --> Less Rust
30
20
10
0
-10
-20
-30
-40
-50
-60
0
1000
2000
3000
4000
5000
6000
Aging Miles
Inventive
Baseline

LUBRICANT ADDITIVES FOR PERFORMANCE BOOSTING

CROSS-REFERENCE TO RELATED APPLICATION

This Application claims priority under 35 U.S.C. 119(e) to U.S. Provisional Application Ser. No. 63/509,813 filed on Jun. 23, 2023, the disclosure of which is hereby incorporated by reference in its entirety.

TECHNICAL FIELD

The present disclosure relates to booster additive packages for lubricating compositions and, in particular, booster additive packages and lubricant compositions including such booster additive packages suitable for improving lubricant performance including at least one of deposits, sludge, wear, TBN retention, and/or rust protection while maintaining API and/or ILSAC licensing.

BACKGROUND

Automotive manufacturers continue to the push for improved efficiency, fluid longevity, and fuel economy, and as such, demands on engines, lubricants, and their components continue to increase. To this end, industry standards and/or automotive manufacturers require certain performance criteria to ensure that today's lubricants meet the demanding performance of vehicle and engine manufacturers. The American Petroleum Institute (API) and/or the International Lubricant Standardization and Approval Committee (ILSAC), for example, provide standards established by various vehicle and engine manufacturers, technical societies, and/or trade associations such as ASTM, SAE, and/or the American Chemistry Council (ACC) to ensure today's automotive lubricants meet specified performance requirements. API's Engine Oil Licensing and Certification System is a program that permits engine oils, that meet specified requirements, to be identified via one or more API and/or ILSAC certification marks or symbols.

Aftermarket supplements have been proposed for treating an existing fresh or used motor oil. However, a shortcoming when adding supplements, boosters, and/or so-called top-treat additives with an already API or ILSAC licensed motor oil is that the combined motor oil and supplement often no longer meet API and/or ILSAC licensing criteria. Meaning, the top-treated or supplemented motor oil is likely deficient in one or more performance criteria set by industry or manufacturers. Currently, no such supplements, boosters, or other top-treat lubricant additives are known to exist that can be added to a fresh or used motor oil that also maintains API and/or ILSAC licensing at the same time.

SUMMARY

In one approach or embodiment, a booster additive package for a passenger car motor oil lubricating composition suitable for improving at least one of deposits, sludge, wear, TBN, and rust protection while maintaining API and/or ILSAC licensing is described herein. In one aspect, the booster additive package includes one or more oil soluble nitrogen-containing compounds providing about 1000 ppm to about 8500 ppm of nitrogen to the booster additive package, preferably about 1000 ppm to about 6000 ppm, and more preferably, about 1100 ppm to about 5800 ppm of nitrogen; and one or more detergent additives providing about 0.2 weight percent to about 5 weight percent soap to the booster additive package.

In other approaches, the booster additive package described in the previous paragraph may include one or more optional features or embodiments in any combination. These optional features or embodiment may include one or more of the following: wherein the booster additive package is configured, upon addition to a fresh and/or used passenger car motor oil composition, to maintain API SP and/or GF-6 certifications; and/or when the booster additive package is added to a passenger car motor oil lubricating composition, the combination of the passenger car motor oil lubricating composition and the booster additive package are licensable with the American Petroleum Institute (API) and/or the International Lubricant Standardization and Approval committee (ILSAC); and/or wherein at least about 90 weight percent of the detergent soap, preferably at least about 95 weight percent, more preferably at least about 98 weight percent, and most preferably 100 weight percent of the detergent soap is provided by the one or more detergent additives having a total base number (TBN) of about 250 mg KOH/g or more; and/or wherein the one or more detergent additives have a total base number of about 280 mg KOH/g or more, about 300 mg KOH/g or more, about 320 mg KOH/g or more, or about 350 mg KOH/g or more; and/or wherein the one or more detergent additives include a magnesium-containing detergent additive; and/or wherein the one or more detergent additives include only a magnesium-containing detergent additive; and/or wherein the one or more detergent additives contribute a total base number (TBN) to the booster additive package of about 5 mg KOH/g to about 40 mg KOH/g as measured pursuant to ASTM D2896, and/or wherein a TBN/ounce of the booster additive package is about 0.5 to about 16 mg KOH/g per ounce of the booster additive package; and/or wherein about 65 to about 100 percent of the detergent TBN is provided by one or more magnesium-containing detergent additives; and/or wherein the booster additive package includes about 1000 ppm to about 10,000 ppm of magnesium from a magnesium-containing detergent, preferably about 1200 ppm to about 8000 ppm, and more preferably about 1400 ppm to about 7800 ppm of the magnesium and/or wherein the booster additive package includes about 100 ppm of magnesium/ounce of the booster additive package to about 5000 ppm of magnesium/ounce of the booster additive package; and/or wherein the oil soluble nitrogen-containing compound incudes an aminic antioxidant; and/or wherein the oil soluble nitrogen-containing compound is an aminic antioxidant selected from the group comprising aromatic amines, alkylated diphenyl amines, alkyl (e.g., nonyl) diphenylamine, di-alkyl (e.g., di-nonyl) diphenylamine, octyl diphenylamine, di-octyl diphenylamine, phenyl-alpha-naphthylamines, alkylated phenyl-alpha-naphthylamines, hindered non-aromatic amines, or combinations thereof; and/or wherein the oil soluble nitrogen-containing compound is a di-alkyl diphenylamine aminic antioxidant, preferably a di-nonyl diphenylamine aminic antioxidant; and/or wherein the booster additive package includes about 2 to about 20 weight percent of the aminic antioxidant; and/or wherein the booster additive package includes one or more aminic antioxidants providing about 1000 ppm to about 6000 ppm of antioxidant nitrogen and/or wherein the booster additive package has about 100 ppm of antioxidant nitrogen per ounce of the booster additive package to about 3000 ppm of antioxidant nitrogen per ounce of the booster additive package; and/or wherein a ratio of detergent total base number (TBN) to detergent total soap content is about 10:1 to about 15:1; and/or wherein about 90 to about 100 percent of the nitrogen is provided by an aminic antioxidant; and/or wherein the booster additive package further includes one or more ashless dispersants obtainable by reacting a hydrocarbyl substituted acylating agent with a nitrogen source; and/or wherein the acylating agent is maleic anhydride and the nitrogen source is selected from ammonia, a polyalkylene polyamine, or combinations thereof; and/or wherein the nitrogen source is the polyalkylene polyamine selected from a mixture of polyethylene polyamines having an average of 5 nitrogen atoms, triethylenetetraamine, tetraethylenepentamine, or combinations thereof; and/or wherein the ashless dispersant is post-treated with one or more of boron, carboxylic acids or derivatives thereof, and combinations thereof; and/or wherein the booster additive package includes about 2 to about 20 weight percent of the ashless dispersant; and/or wherein the booster additive packaging includes about 400 to about 2500 ppm of dispersant nitrogen provided by the one or more ashless dispersants and/or wherein the booster additive package includes about 40 ppm of dispersant nitrogen per ounce of the booster additive package to about 1300 ppm of dispersant nitrogen per ounce of the booster additive package; and/or wherein the booster additive package further includes a calcium-containing detergent additive; and/or wherein the booster additive package further includes about 900 ppm to about 5,000 ppm of calcium from the calcium-containing detergent additive and/or wherein the booster additive package includes about 90 ppm of detergent calcium per ounce of the booster additive package to about 2,500 ppm of detergent calcium per ounce of the booster additive package.

In further approaches or embodiments, a lubricating composition suitable for improving at least one deposits, sludge, wear, TBN retention, and rust protection is described herein. In aspects of this embodiment, the lubricating composition includes (a) a fresh or used passenger car motor oil lubricating composition including (i) one or more base oils of lubricating viscosity; (ii) a dispersant inhibitor additive package; and (iii) optionally, a viscosity index improver; and (b) any embodiment of the booster additive package as described in the previous two paragraphs.

In other approaches or embodiments, the lubricating composition of the previous paragraph may include one or more optional features or embodiments in any combination. These optional features or embodiment may include one or more of the following: wherein the combination of (a) the passenger car motor oil lubricating composition and (b) the booster additive package is API SP and/or GF-6 capable and/or wherein the passenger car motor oil lubricating composition is a fresh passenger car motor oil composition or a used passenger car motor oil composition; and/or wherein the combination of (a) the fresh or the used passenger car motor oil lubricating composition and (b) the booster additive package is licensable with the American Petroleum Institute (API) and/or the International Lubricant Standardization and Approval committee (ILSAC); and/or wherein the booster additive package is added in an amount effective to provide one or more of (a) increasing the total nitrogen content by at least about 5% relative to the passenger car motor oil lubricating composition (preferably, about 5 to about 15% increase); (b) increasing the magnesium content by at least about 20% relative to the passenger car motor oil lubricating composition (preferably, about 20 to about 50% increase); (c) increasing the magnesium soap content by at least about 20% relative to the passenger car motor oil lubricating composition (preferably about 20 to about 50% increase in magnesium soap content); or (d) combination thereof; and/or wherein the lubricating composition has at least one of (a) about 450 ppm to about 550 ppm of magnesium provided from the passenger car motor oil lubricating composition and the booster additive package combined; (b) about 700 to about 1200 ppm of total nitrogen provided from the passenger car motor oil lubricating composition and the booster additive package combined; (c) about 0.5 to about 1.0 weight percent of soap content from the passenger car motor oil lubricating composition and the booster additive package combined; or (d) combination thereof; and/or wherein the lubricating composition exhibits a higher rust protection for up to about 6000 miles of lubrication when measured pursuant to ASTM D6557 as compared to a baseline lubricating composition with the passenger car motor oil composition but without the booster additive package and/or wherein the passenger car motor oil composition is one of a fresh passenger car motor oil competitions or a used passenger car motor oil composition; and/or wherein a used passenger car motor oil composition has lubricated a combustion engine for at least 1000 miles, 2000 miles, 3000 miles, 4000 miles, 5000 miles, 6000 miles, 8000 miles, or 10,000 miles; and/or wherein the lubricating composition includes about 1 to about 10 weight percent of the booster additive package, preferably about 1.1 to about 8 weight percent, more preferably about 1.2 to about 6.5 weight percent, and most preferably about 1.2 to about 6.3 weight percent of the booster additive package; and/or wherein the dispersant inhibitor package includes one or more of dispersants, detergents, antiwear additives, antioxidants, friction modifiers, pour point dispersants, seal swell agents, or combinations thereof.

In yet further approaches or embodiments, a method for providing rust protection to a valve train component of a passenger car engine is described herein. In aspects of this embodiment, the method includes lubricating the valve train component of the passenger car engine with any embodiment of the lubricating composition as described in this Summary; and wherein the valve train component maintains a higher level of rust protection for up to 6000 miles of lubrication as compared to a lubricating composition with the passenger car motor oil composition but without the booster additive package.

In other approaches or embodiments, the method of the previous paragraph may include one or more optional features, steps, or embodiments in any combination. These optional features, steps, or embodiments may include one or more of the following: wherein the rust protection is determined using ASTM D6557; and/or wherein the lubricating composition is a used lubricating composition that has lubricated a combustion engine for at least 1000 miles, 2000 miles, 3000 miles, 4000 miles, 5000 miles, 6000 miles, 8000 miles, or 10,000 miles.

In further approaches or embodiments, a further method for providing rust protection to a valve train component of a passenger car engine with a lubricating composition is described herein. In aspects, the method includes providing a passenger car motor oil lubricating composition including one or more detergent additives providing up to about 0.5 weight percent soap to the passenger car motor oil lubricating composition and one or more oil-soluble nitrogen containing compounds providing up to about 600 ppm dispersant nitrogen to the passenger car motor oil lubricating composition; adding a booster additive package to the passenger car motor oil lubricating composition to form the lubricating composition; and wherein the lubricating composition maintains a higher level of rust protection to the valve train components than a lubricating composition including the passenger car motor oil lubricating composition but without the booster additive package.

In further embodiments, the method for providing rust protection of the previous paragraph may also include one or more optional features, steps, or embodiments in any combination. These optional features, steps, or embodiments may include one or more of the following: wherein the lubricating composition is described in any embodiments of this Summary; and/or wherein the booster additive package is described in any embodiments as described in this Summary; and/or wherein the combination of (a) the passenger car motor oil lubricating composition and (b) the booster additive package is API SP and/or GF-6 capable; and/or wherein the combination of (a) the passenger car motor oil lubricating composition and (b) the booster additive package is licensable with the American Petroleum Institute (API) and/or the International Lubricant Standardization and Approval committee (ILSAC); and/or wherein the booster additive package is added in an amount effective to provide one or more of (a) increasing the total nitrogen content by at least about 5% relative to the passenger car motor oil lubricating composition (preferably, about 5 to about 15% increase); (b) increasing the magnesium content by at least about 20% relative to the passenger car motor oil lubricating composition (preferably, about 20 to about 50% increase); (c) increasing the magnesium soap content by at least about 20% relative to the passenger car motor oil lubricating composition (preferably about 20 to about 50% increase in magnesium soap content); or (d) combination thereof.

In further approaches or embodiments, a method for lubricating an engine crankcase with a lubricating composition is described herein. In aspects, the method includes providing a passenger car motor oil lubricating composition including one or more detergent additives providing up to about 0.5 weight percent soap and one or more oil-soluble nitrogen containing compounds providing up to about 600 ppm dispersant nitrogen; adding a booster additive package to the passenger car motor oil lubricating oil composition to form the lubricating composition; and lubricating the engine crankcase with the lubricating composition.

In further approaches or embodiments, the method of the previous paragraph may include one or more optional features, steps, or embodiments in any combination. These optional features, steps, or embodiments may include one or more of the following: wherein the lubricating composition is described in any embodiment of this Summary; and/or wherein the booster additive package is described in any embodiment of this Summary; and/or wherein the combination of (a) the passenger car motor oil lubricating composition and (b) the booster additive package is API SP and/or GF-6 capable; and/or wherein the combination of (a) the passenger car motor oil lubricating composition and (b) the booster additive package is licensable with the American Petroleum Institute (API) and/or the International Lubricant Standardization and Approval committee (ILSAC); and/or wherein the additive booster package is added in an amount effective to provide one or more of (a) increasing the total nitrogen content by at least about 5% relative to the passenger car motor oil lubricating composition (preferably, about 5 to about 15% increase); (b) increasing the magnesium content by at least about 20% relative to the passenger car motor oil lubricating composition (preferably, about 20 to about 50% increase); (c) increasing the magnesium soap content by at least about 20% relative to the passenger car motor oil lubricating composition (preferably about 20 to about 50% increase in magnesium soap content); or (d) combination thereof; and/or wherein the lubricating composition exhibits a higher rust protection for up to about 6000 miles of lubrication pursuant to ASTM D6557 as compared to a baseline lubricating composition with the passenger car motor oil composition but without the booster additive package.

BRIEF DESCRIPTION OF DRAWING FIGURES

FIG. 1 is graph of rust protection for up to 6,000 miles measured pursuant to ASTM D6557 comparing a conventional GF-6 motor oil to a boosted GF-6 motor oil that still maintains licensing certifications.

DETAILED DESCRIPTION

The present disclosure relates to a supplement or a concentrate in the form of a booster additive package for motor oils or lubricants, to finished lubricants including such concentrate or booster additive package as a top treat to passenger car motor oils, and to methods of lubricating or improving the performance of a motor oil that includes at least one of improved deposits, sludge, wear, TBN retention, and/or rust protection. Surprisingly, the supplements or the booster additive packages herein, when top treated to passenger car motor oils to form finished lubricants, not only provide the improved performance, but also maintain API and/or ILSAC licensing requirements and, in particular, maintain API SP and/or GF-6 certifications.

As shown in the Examples below and in FIG. 1, the booster additive packages herein, when top-treated to passenger car motor oils at about 0.5 to about 2 weight percent (preferably about 0.8 to about 1.8 weight percent as a top treat) to form a finished lubricant including the top-treat provided higher initial rust protection and maintained a higher level of rust protection for a longer time as compared to a untreated conventional GF-6 motor oil. As used herein, rust protection was evaluated using the Ball Rust Test of ASTM D6557.

Turning to more of the specifics, the booster additive packages herein are configured as top-treat supplements or additives for an API or ILSAC licensed passenger car motor oil to boost or increase one or more of nitrogen, calcium, total base number (TBN), and/or soap content to form a finished lubricant that maintains licensing requirements. As used herein, a finished lubricant (or finished lubricating composition) refers to a blend including a passenger car motor oil (or passenger car motor oil lubricating composition) and the booster additive packages described herein as combined composition. A passenger car motor oil (or a passenger car motor oil lubricating composition) refers to a lubricant with a base oil of lubricating viscosity, a dispersant inhibitor additive package, and an optional viscosity index improver (and without the booster additive package). As discussed more below, the booster additive packages include at least oil soluble nitrogen-containing compounds, detergent additives, and process oil/base oil of lubricating viscosity.

In one embodiment, the supplement or booster additive packages herein include at least (i) one or more oil soluble nitrogen-containing compounds providing about 1000 ppm to about 8500 ppm of nitrogen to the booster additive package (preferably, about 1000 ppm to about 6000 ppm, and more preferably, about 1100 ppm to about 5800 ppm of nitrogen to the booster additive package); and (ii) one or more detergent additives providing about 0.2 weight percent to about 5 weight percent soap to the booster additive package (preferably, about 0.4 to about 4 weight percent of overbased soap, and more preferably, about 0.4 to about 3 weight percent of overbased magnesium-containing soap). The supplements or booster additive packages herein are configured, upon addition to a fresh and/or a used passenger car motor oil composition forming the finished lubricant, to maintain API and/or ILSAC certifications such as SP and/or GF-6 certifications. In other words, when the booster additive packages herein are added to a passenger car motor oil lubricating composition, the combination of the passenger car motor oil lubricating composition and the booster additive package are still licensable with the American Petroleum Institute (API) and/or the International Lubricant Standardization and Approval committee (ILSAC).

Oil Soluble Nitrogen-Containing Compounds

The booster additive package is generally in the form of a concentrate that includes, among other components, one or more oil-soluble nitrogen-containing compounds providing a selected amount of nitrogen to the concentrate and configured to selectively boost the nitrogen content of the passenger car motor oil in the finished lubricants herein. As noted above, the selected oil soluble nitrogen-containing compounds are in amounts to provide about 1000 ppm to about 8500 ppm of nitrogen to the booster additive package, preferably about 1000 ppm to about 6000 ppm, and more preferably, about 1100 ppm to about 5800 ppm of nitrogen to the booster additive package. In other embodiments, the oil soluble nitrogen-containing compounds in the booster are in amounts to provide about 100 ppm of nitrogen per ounce of the booster to about 4500 ppm of nitrogen per ounce of the booster (in other approaches, about 100 ppm of nitrogen per ounce to about 3000 ppm of nitrogen per ounce, or about 110 ppm of nitrogen per ounce to about 2900 ppm of nitrogen per ounce of the booster).

The amounts of the oil-soluble nitrogen-containing compound in the booster is configured to increase the total nitrogen content of the finished lubricant (e.g., the PCMO and booster) by at least about 5 percent relative to the untreated passenger car motor oil lubricating composition (preferably, an increase of the total nitrogen content by about 5 to about 15 percent). In embodiments, the oil soluble nitrogen-containing compounds may be an antioxidant, a dispersant, or combinations thereof. Preferably, the oil soluble nitrogen-containing compounds is one or more aminic antioxidants, and more preferably the nitrogen content of the booster is only provided by the one or more aminic antioxidants.

Antioxidant Nitrogen: In one embodiment, the nitrogen content of the booster additive package is provided by one or more antioxidants and, more preferably, one or more aminic antioxidants. For instance, the booster additive packages or concentrates herein may include about 2 to about 20 weight percent (in other approaches, about 2 to about 18 weight percent, or about 3 to about 15 weight percent) of one or more aminic antioxidants to provide the above-noted nitrogen contents of the booster. In approaches, the booster additive packages herein may increase the amount of aminic antioxidants in the finished lubricant (e.g., PMCO plus booster) about 10 to about 30 percent over an aminic antioxidant content of the untreated passenger car motor oil.

In some approaches or embodiments, suitable aminic antioxidants may include, but are not limited to, antioxidants selected from aromatic amines, alkylated diphenyl amines, alkyl (e.g., nonyl) diphenylamine, di-alkyl (e.g., di-nonyl) diphenylamine, octyl diphenylamine, di-octyl diphenylamine, phenyl-alpha-naphthylamines, alkylated phenyl-alpha-naphthylamines, hindered non-aromatic amines, or combinations thereof. Preferably, the oil soluble nitrogen-containing component is a di-alkyl diphenylamine and, more preferably, a di-nonyl diphenylamine. In one approach, the only nitrogen source in the booster additive packages herein is the aminic antioxidant, and in such approach, may include about 1000 to about 6000 ppm of the antioxidant nitrogen or, in other approaches, about 100 to about 3000 ppm of the antioxidant nitrogen per ounce of the booster.

Once top-treated, the total amount of antioxidant in the finished lubricating compositions (e.g., the PCMO plus the booster) herein may be in amounts to provide up to about 400 ppm of antioxidant nitrogen, or up to about 350 ppm antioxidant nitrogen, or up to about 325 ppm antioxidant nitrogen, or up to about 315 ppm of antioxidant nitrogen. In other approaches, the total amount of the antioxidant nitrogen in the lubricant compositions may provide about 200 to about 400 ppm antioxidant nitrogen, about 250 to about 350 ppm antioxidant nitrogen, about 300 to about 325 ppm antioxidant nitrogen. Such total nitrogen may be provided by about 100 to about 300 ppm of aminic nitrogen in the passenger car motor oil and about 50 to about 80 ppm of aminic nitrogen from the booster concentrate. In other approaches, the finished lubricating compositions herein may include up to about 1 weight percent of the aminic antioxidant, or about 0.1 to about 1.0 weight percent of the aminic antioxidant, in other approaches, about 0.5 to about 1.0 weight percent, or about 0.5 to about 0.95 weight percent of the aminic antioxidant provided from both the passenger car motor oil and the booster combined (with about 70 to about 80 weight percent of the aminic antioxidant from the PMCO and about 20 to about 30 weight percent from the booster).

In some approaches or embodiments, the aminic antioxidant may be one or more aromatic amine antioxidants and may include, but are not limited to, diarylamines having the formula:

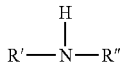

wherein R' and R" each independently represents a substituted or unsubstituted aryl group having from 6 to 30 carbon atoms. If substituted, suitable substituents for the aryl group of R' and R" include aliphatic hydrocarbon groups such as alkyl having from 1 to 30 carbon atoms, hydroxy groups, halogen radicals, carboxylic acid or ester groups, or nitro groups. The aryl group may be substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. In approaches, one or both aryl groups may be substituted, e.g. mono-alkylated diphenylamine, di-alkylated diphenylamine, C9 alkylated diphenyl amines, or mixtures of mono- and di-alkylated diphenylamines.

Examples of diarylamines that may be used include, but are not limited to: diphenylamine; various alkylated diphenylamines, 3-hydroxydiphenylamine, N-phenyl-1,2-phenylenediamine, N-phenyl-1,4-phenylenediamine, monobutyldiphenyl-amine, dibutyl-diphenylamine, monooctyldiphenylamine, dioctyldiphenylamine, monononyl-diphenylamine, dinonyldiphenylamine, monotetradecyldiphenylamine, ditetradecyl-diphenylamine, phenyl-alpha-naphthylamine, monooctyl phenyl-alpha-naphthylamine, phenyl-beta-naphthylamine, monoheptyldiphenylamine, diheptyl-diphenylamine, p-oriented styrenated diphenylamine, mixed butyloctyldiphenylamine, and mixed octylstyryl-diphenylamine.

In other approaches, suitable antioxidants may include aromatic amine antioxidants. Examples of phenolic antioxidants include N,N'-di-sec-butyl-phenylenediamine, 4-iisopropylamino diphenylamine, phenyl-alpha-naphthyl amine, phenyl-alpha-naphthyl amine, and ring-alkylated diphenylamines.

As noted above, the booster additive package may include about 2 to about 20 weight percent of an aminic antioxidant providing about 1000 to about 6000 ppm of antioxidant nitrogen to the booster or, in other approaches, about 100 ppm to about 3000 ppm of antioxidant nitrogen per ounce of the booster. In other approaches, the finished lubricants (including both the passenger car motor oil and the booster additive package) may include about 0.5 to about 5 weight percent of total antioxidants and with the booster additive package providing the increase in aminic antioxidants as noted above. Preferably, about 90 to about 100 weight percent of the nitrogen in booster is provided by an aminic antioxidant.

Nitrogen from Dispersant: The booster additive packages herein may also optionally include an dispersant additive providing additional oil soluble nitrogen-containing compounds. If included in the booster, the dispersant may be obtained by reacting a hydrocarbyl-substituted acylating agent with a nitrogen source and may be an ashless dispersant such as one or more hydrocarbyl-substituted succinimide dispersants. If included, the booster may further include an additional 400 to 2500 ppm of dispersant nitrogen in the booster or, in other approaches, about 40 to about 1300 ppm of dispersant nitrogen per ounce of the booster. Preferably, the one or more dispersant additives in the booster may include polyisobutylene succinimide dispersants derived from a highly reactive polyisobutylene having a number average molecular weight of at least about 2,000 and, preferably, a polyisobutylene succinimide dispersant derived from highly reactive polyisobutylene having a number average molecular weight of about 2,000 to about 5,000; about 2,000 to about 3,000; or about 2,000 to about 2,600.

Dispersants are often known as ashless-type dispersants because, prior to mixing in a lubricating composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of nitrogen-substituted long chain alkenyl succinimides include polyisobutylene succinimide with the number average molecular weight of the polyisobutylene substituent being in the range about 350 to about 50,000, or as noted above preferably up to about 5,000, or up to about 3,000 as measured by GPC. Succinimide dispersants and their preparation are disclosed, for instance in U.S. Pat. No. 7,897,696 or U.S. Pat. No. 4,234,435, which are incorporated herein by reference. The alkenyl substituent may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

In approaches, preferred amines for the dispersants may be selected from polyamines and hydroxylamines. Examples of polyamines that may be used include, but are not limited to, diethylene triamine (DETA), triethylene tetramine (TETA), tetraethylene pentamine (TEPA), and higher homologues such as pentaethylamine hexamine (PEHA), and the like. In some approaches, a so-called heavy polyamine may be used, which is a mixture of polyalkylene-polyamines comprising small amounts of lower polyamine oligomers such as TEPA and PEHA (pentaethylene hexamine) but primarily oligomers with 6 or more nitrogen atoms, 2 or more primary amines per molecule, and more extensive branching than conventional polyamine mixtures. A heavy polyamine preferably includes polyamine oligomers containing 7 or more nitrogen atoms per molecule and with 2 or more primary amines per molecule.

In some embodiments, polyisobutylene (PIB), when included, is a preferred reactant to form the dispersants and may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000, as determined by GPC, is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3,000 may be suitable, as determined by GPC or, preferably about 2,000 to about 3,000. Such HR-PIB is commercially available, or can be synthesized by the polymerization of isobutene in the presence of a non-chlorinated catalyst such as boron trifluoride, as described in U.S. Pat. No. 4,152,499 and/or U.S. Pat. No. 5,739,355. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696. In one embodiment, the present disclosure further comprises at least one dispersant derived from polyisobutylene succinic anhydride ("PIBSA"). The PIBSA may have an average of between about 1.0 and about 2.0 succinic acid moieties per polymer.

In some approaches, the dispersants in the booster additive packages herein, if included, may be free of any post-treatments, such as post treatments with boron, urea, thiourea, dimercapto thiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compound. In other approaches, the dispersants of the booster additive package, if included, may be post-treated by conventional methods by a reaction with any of a variety of agents and/or dispersants in the passenger car motor oil lubricating composition may be post-treated. Additionally, at least one of the dispersants in the passenger car motor oil may be post treated. Suitable post treat agents include boron, urea, thiourea, dimercapto thiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. (See, e.g., U.S. Pat. Nos. 7,645,726; 7,214,649; 8,048,831; and 5,241,003, which are all incorporated herein by reference in their entireties.)

If post treated with boron, the boron compound used as a post-treating reagent can be selected from boron oxide, boron halides, boron acids and esters of boron acids in an amount to provide from about 0.1 atomic proportion of boron for each mole of the nitrogen composition to about 20 atomic proportions of boron for each atomic proportion of nitrogen used. The dispersant post-treated with boron may contain from about 0.05 weight percent to about 2.0 weight percent, or in other approaches, about 0.05 weight percent to about 0.7 weight percent boron, based on the total weight of the borated dispersant.

In other approaches and if used, the carboxylic acid may also be used as a post-treating reagent and can be saturated or unsaturated mono-, di-, or poly-carboxylic acid. Examples of carboxylic acids include, but are not limited to, maleic acid, fumaric acid, succinic acid, and naphthalic diacid (e.g., 1,8-naphthalic diacid). Anhydrides can also be used as a post-treating reagent and can be selected from the group consisting of mono-unsaturated anhydride (e.g., maleic anhydride), alkyl or alkylene-substituted cyclic anhydrides (e.g., succinic anhydride or glutamic anhydride), and aromatic carboxylic anhydrides (including naphthalic anhydride, e.g., 1,8-naphthalic anhydride).

In one embodiment and if used, the process of post-treating the dispersant includes first forming the succinimide product, as described above, and then further reacting the succinimide product with the post treating agent, such as a boron compound, such as boric acid. In some cases, the dispersants herein may be post-treated with more than one post-treatment agents. For example, the dispersant may be post-treated with a boron compound, such as boric acid, and also an anhydride, such as maleic anhydride and/or 1,8-naphthalic anhydride.

If included, the booster additive packages herein may include about 2 to about 20 weight percent of the dispersant (which is preferably not-post treated) providing the above-noted levels of optional additional nitrogen to the booster. Finished lubricants of the present application (again PCMO and booster) may include about 1 to about 5 weight percent of total dispersant provided from dispersant in the booster additive package and dispersants in the passenger car motor oil that may be a blend of non-post treated dispersants (provided from the booster and the passenger car motor oil) and post-treated dispersant provided form the passenger car motor oil. In some embodiments, the finished lubricants herein may be about 75 to about 85 weight percent of dispersant from the PMCO and about 15 to about 25 weight percent of dispersant from the booster.

In other embodiments, the total amount of dispersant in the finished lubricant can be provided from both the passenger car motor oil and from the booster in an amount sufficient to provide up to about 15 weight percent of the finished lubricating composition (preferably about 2 to about 10 weight percent) and wherein one or more of the dispersants (preferably from the passenger car motor oil and not the booster) are post treated to provide at least about 40 ppm of boron and up to 500 ppm of boron to the lubricating composition (preferably, about 100 to about 200 ppm boron). In other approaches, the dispersant may be used in the finished lubricating composition in amounts from about 0.1 weight percent to about 15 weight percent, or about 0.1 weight percent to about 10 weight percent, about 0.1 weight percent to 8 weight percent, or about 1 weight percent to about 10 weight percent, or about 1 weight percent to about 8 weight percent, or about 1 weight percent to about 6 weight percent, based upon the final weight of the lubricating oil composition.

The Detergent Additives

The booster additive package also includes one or more detergent additives in amounts to provide about 0.2 to about 5 weight percent soap to the booster additive package (in other approaches, about 0.3 to about 4 weight percent or about 0.4 to about 3 weight percent soap). In one approach, at least about 90 weight percent of the detergent soap, preferably at least about 95 weight percent, more preferably at least about 98 weight percent, and most preferably 100 weight percent of the detergent soap is provided by the one or more overbased detergent additives having a total base number (TBN) of about 250 mg KOH/g or more (preferably about 250 to about 500 mg KOH/g) with TBN determined pursuant to ASTM D2896.

In one approach or embodiment, the one or more detergent additives of the booster additive package preferably include a magnesium-containing detergent additive, and more preferably a sulfonate-based, magnesium-providing detergent. In other approaches, the booster additive package includes only magnesium-containing detergent additives, and preferably only magnesium sulfonate-based detergents having the high TBN contents noted above. These select detergent additives contribute a total base number (TBN) to the booster of at least about 5 mg KOH/g, at least about 10 mg KOH/g, at least about 520 mg KOH/g, or at least about 30 mg KOH/g as measured pursuant to ASTM D2896, and in other approaches or embodiments, the detergents herein provide a TBN of about 40 mg KOH/g or less to the booster additive package. In yet other approaches, the detergent additives provide a TBN per ounce of the booster from about 0.5 to about 16 mg KOH/g per ounce of the booster additive package. While the booster additive package may optionally contain other detergent additives (such as a calcium-containing detergent additive), about 65 to about 100 percent of the detergent TBN noted above is provided by the one or more overbased magnesium-containing detergent additives (preferably, 80 to about 100 percent, and more preferably, about 90 to about 100 percent).

In other embodiments, the booster additive packages herein include up to about 10,000 ppm of magnesium from the magnesium-containing detergent, up to about 8,000 ppm of magnesium, or up to about 7,800 ppm of magnesium from a magnesium-containing detergent and/or the booster additive package includes at least about 1,000 ppm of magnesium from a magnesium-containing detergent, at least about 1,200 ppm of magnesium, or at least about 1,400 ppm of magnesium from the magnesium-containing detergent(s) or any ranges therebetween. In other approaches, the booster additive package includes about 100 ppm of magnesium per ounce of the booster additive package to about 5000 ppm of magnesium per ounce of the booster additive package.

The booster additive package and the select detergent additives thereof are configured to increase the magnesium and, preferably, increase the overbased soap content of a passenger car motor oil lubricating composition. That is, the booster additive package is configured to be added to a passenger car motor oil composition to form a finished lubricant (e.g., PMCO plus booster) with higher levels of magnesium and/or overbased soap as compared to the magnesium and soap contents of the untreated passenger car motor oil lubricating composition. In approaches or embodiments, the booster additive packages herein increase the magnesium content by at least about 20% relative to the untreated passenger car motor oil lubricating composition (preferably, about 20 to about 50% increase) and/or increase the overbased or magnesium soap content by at least about 20% relative to the passenger car motor oil lubricating composition (preferably about 20 to about 50% increase in overbased or magnesium soap content).

In other embodiments, the finished lubricating compositions herein (that is both the passenger car motor oil lubricating composition and booster additive package as a top-treat thereto) have about 400 ppm to about 1000 ppm of total magnesium provided from the passenger car motor oil lubricating composition and the booster additive package combined and/or about 0.1 to about 0.2 weight percent total soap content (e.g., overbased or magnesium soap content) provided form the passenger car motor oil lubricating composition and the booster additive package combined. In embodiments, about 75 to about 85 weight percent of the finished lubricant is a magnesium-containing detergent from the PMCO and about 15 to about 25 weight percent is a magnesium-containing detergent from the booster.

Suitable detergents and their methods of preparation are described in greater detail in numerous patent publications, including U.S. Pat. No. 7,732,390 and references cited therein, which are incorporated herein by reference. The booster additive packages herein may include about 1 to about 10 weight percent of individual and/or total detergent additives, and in other approaches, about 1.5 to about 8 weight percent so long as the detergent additives meet the magnesium, sulfonate and/or soap contents noted herein. Similarly, the finished lubricating compositions herein (again the combination of the passenger car motor oil and the booster additive package) include about 0.5 to about 2 weight percent of the booster additive packages herein as a top-treat may include about 0.1 to about 5 weight percent of individual and/or total detergent additives (including detergents provided by the booster and detergents provided by the lubricant), and in other approaches, about 0.15 to about 3 weight percent, and in yet other approaches, about 0.15 to 2.6 weight percent of individual and/or total detergent additives (from both the booster and the lubricant) so long as the detergent additives meet the calcium, sulfonate and/or soap contents noted herein.

As noted above and in some approaches, the detergent system of the booster additive package provides select amounts of magnesium soap, sulfonate soap, and/or overbase soap and select TBN levels of these detergent metals. The booster additive package includes at least about 0.2 weight percent soap, and preferably about 0.2 to about 5 percent soap, and more preferably about 0.2 to about 5 weight percent overbased magnesium based soap (or other amounts as noted above). In other approaches, a ratio of detergent total base number (TBN) of the booster additive package to total detergent soap content in the booster additive package is at least about 10:1, at least about 12:1, or at least about 14:1, and in other approaches, about 10:1 to about 15:1. Preferably, the soap content of the booster additive package is predominately overbased magnesium-based soap; as such, the noted ratio of detergent TBN to detergent soap of the booster additive package is a ratio of the detergent TBN to the overbased/magnesium-based detergent soap in the booster additive package.

Generally, suitable detergents in the booster or lubricants herein (subject to the noted requirements of magnesium, TBN, and soap contents herein) may include linear or branched alkali or alkaline earth metal salts, such as calcium, sodium, or magnesium, of petroleum sulfonic acids and long chain mono- or di-alkylaryl sulfonic acids with the aryl group being benzyl, tolyl, and xylyl and/or various phenates or derivatives of phenates. Examples of suitable detergents include, subject the required amounts of sulfonate soap noted above, low-based/neutral and overbased variations of the following detergents: calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

As understood, overbased detergent additives are well-known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The term "overbased" relates to metal salts, such as metal salts of sulfonates, carboxylates, salicylates and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the MR is one and in an overbased salt, MR, is greater than one. They are commonly referred to as overbased, hyperbased, or superbased salts and may be salts of organic sulfur acids, carboxylic acids, or phenols.

As used herein, the term "TBN" is used to denote the Total Base Number in mg KOH/g as measured by the method of ASTM D2896. The detergent may be neutral or overbased. For example, a low-base or neutral detergent herein may have a total base number (TBN) of up to about 250 mg KOH/gram as noted above. Overbased detergents, which may be provided in the passenger car motor oil and/or the finished lubricants herein, may have a total base number (TBN) of about 250 mg KOH/gram or greater, or about 300 mg KOH/gram or greater, or about 350 mg KOH/gram or greater, or about 375 mg KOH/gram or greater, or about 400 mg KOH/gram or greater and generally less than about 500 mg KOH/gram. The overbased detergent may have a metal to substrate ratio of from 1.1:1 or less, or from 2:1 or less, or from 4:1 or less, or from 5:1 or less, or from 7:1 or less, or from 10:1 or less, or from 12:1 or less, or from 15:1 or less, or from 20:1 or less.

Examples of suitable overbased detergents (subject to the other limitations on detergents noted above) include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

As noted above, the booster additive package is preferably configured to increase the magnesium content in a finished lubricant over that provided by the passenger car motor by at least about 20% relative to the passenger car motor oil lubricating composition (preferably, about 20 to about 50% increase) and/or increase the overbased or magnesium soap content by at least about 20% relative to the passenger car motor oil lubricating composition (preferably about 20 to about 50% increase in magnesium soap content).

The booster additive packages herein also have high levels of sulfonate soap content, high levels of magnesium soap content, and/or high levels of overbased soap content and, in particular, have at least about 75 percent of such soap, and in other approaches, at least about 80 percent of such soap, at least about 85 of such soap, at least about 90 percent of such soap, at least about 95 of such soap, at least about 98 percent of such soap, at least about 99 percent of such soap, or about 100 percent of such soap (or any ranges therebetween).

Soap content generally refers to the amount of neutral organic acid salt and reflects a detergent's cleansing ability, or detergency, and dirt suspending ability. The soap content of a lubricant can be determined by ASTM D3712. Further discussion on determining soap content can be found in FUELS AND LUBRICANTS HANDBOOK, TECHNOLOGY, PROPERTIES, PERFORMANCE, AND TESTING, George Totten, editor, ASTM International, 2003, relevant portions thereof incorporated herein by reference Base Oil or Base Oil Blend:

The booster additive packages herein may include the additives noted above combined with a majority of process or base oil. A process or base oil herein may be oils of lubricating viscosity and selected from any of the base oils in API Groups I to V as specified in the American Petroleum Institute (API) Base Oil Interchangeability Guidelines. Both the booster additive package and the finished lubricating compositions with the booster may have a KV100 of about 10 to about 15 cSt (ASTM D445). The five base oil groups are generally set forth in Table 1 below:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Group II+ may comprise high viscosity index Group II.

The base oil blend used in the disclosed lubricating oil composition may be a mineral oil, animal oil, vegetable oil, synthetic oil, synthetic oil blends, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in a lubricating composition may be selected from the group consisting of Group I, Group II, a Group III, a Group IV, a Group V, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group II, a Group III, a Group IV, a Group V, and a combination of two or more of the foregoing, and wherein the major amount of base oil is other than base oils that arise from provision of additive components or viscosity index improvers in the composition.

The amount of the oil of lubricating viscosity present may be the balance remaining after subtracting from 100 wt % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about 60 wt %, greater than about 70 wt %, greater than about 80 wt %, greater than about 85 wt %, or greater than about 90 wt %.

The base oil systems herein, in some approaches or embodiments, include one or more of a Group I to Group V base oils and may have a KV100 of about 2 to about 20 cSt, in other approaches, about 5 to about 15 cSt, about 8 to about 15 cSt, in yet other approaches, about 10 to about 15 cSt.

As generally used herein, the terms "oil composition," "lubrication composition," "lubricating oil composition," "lubricating oil," "lubricant composition," "lubricant," and "lubricating" are considered synonymous, fully interchangeable terminology referring to a passenger car motor oil lubrication product comprising a major amount of a base oil component plus minor amounts of the detergents and the other optional components that is preferably API GF-6 capable. A booster additive package is a concentrate configured to be top-treated to the passenger car motor oil to create a finished lubricant. As such, a finished lubricant or a finished lubricating composition includes the passenger car motor oil and the booster additive package combined.

Optional Additives:

The booster additive package and/or the passenger car motor oil lubricating compositions herein may also include a number of optional additives combined with the detergent systems and dispersant system discussed above and as needed to meet performance standards. Those optional additives are described in the following paragraphs.

Dispersants: The lubricating oil composition may optionally include one or more other dispersants or mixtures thereof. Dispersants are often known as ashless-type dispersants because, prior to mixing in a lubricating oil composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with the number average molecular weight of the polyisobutylene substituent being in the range about 350 to about 50,000, or to about 5,000, or to about 3,000, as measured by GPC. Succinimide dispersants and their preparation are disclosed, for instance in U.S. Pat. No. 7,897,696 or U.S. Pat. No. 4,234,435. The alkenyl substituent may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

Preferred amines are selected from polyamines and hydroxylamines. Examples of polyamines that may be used include, but are not limited to, diethylene triamine (DETA), triethylene tetramine (TETA), tetraethylene pentamine (TEPA), and higher homologues such as pentaethylamine hexamine (PEHA), and the like.

A suitable heavy polyamine is a mixture of polyalkylenepolyamines comprising small amounts of lower polyamine oligomers such as TEPA and PEHA (pentaethylene hexamine) but primarily oligomers with 6 or more nitrogen atoms, 2 or more primary amines per molecule, and more extensive branching than conventional polyamine mixtures. A heavy polyamine preferably includes polyamine oligomers containing 7 or more nitrogen atoms per molecule and with 2 or more primary amines per molecule. The heavy polyamine comprises more than 28 wt. % (e.g. >32 wt. %) total nitrogen and an equivalent weight of primary amine groups of 120-160 grams per equivalent.

In some approaches, suitable polyamines are commonly known as PAM and contain a mixture of ethylene amines where TEPA and pentaethylene hexamine (PEHA) are the major part of the polyamine, usually less than about 80%.

Typically, PAM has 8.7-8.9 milliequivalents of primary amine per gram (an equivalent weight of 115 to 112 grams per equivalent of primary amine) and a total nitrogen content of about 33-34 wt. %. Heavier cuts of PAM oligomers with practically no TEPA and only very small amounts of PEHA but containing primarily oligomers with more than 6 nitrogen atoms and more extensive branching, may produce dispersants with improved dispersancy.

In an embodiment the present disclosure further comprises at least one polyisobutylene succinimide dispersant derived from polyisobutylene with a number average molecular weight in the range about 350 to about 50,000, or to about 5000, or to about 3000, as determined by GPC. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000, as determined by GPC, is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000 may be suitable, as determined by GPC. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment, the present disclosure further comprises at least one dispersant derived from polyisobutylene succinic anhydride ("PIBSA"). The PIBSA may have an average of between about 1.0 and about 2.0 succinic acid moieties per polymer.

The % actives of the alkenyl or alkyl succinic anhydride can be determined using a chromatographic technique. This method is described in column 5 and 6 in U.S. Pat. No. 5,334,321.

The percent conversion of the polyolefin is calculated from the % actives using the equation in column 5 and 6 in U.S. Pat. No. 5,334,321.

Unless stated otherwise, all percentages are in weight percent and all molecular weights are number average molecular weights determined by gel permeation chromatography (GPC) using commercially available polystyrene standards (with a number average molecular weight of 180 to about 18,000 as the calibration reference).

In one embodiment, the dispersant may be derived from a polyalphaolefin (PAO) succinic anhydride. In one embodiment, the dispersant may be derived from olefin maleic anhydride copolymer. As an example, the dispersant may be described as a poly-PIBSA. In an embodiment, the dispersant may be derived from an anhydride which is grafted to an ethylene-propylene copolymer.

A suitable class of nitrogen-containing dispersants may be derived from olefin copolymers (OCP), more specifically, ethylene-propylene dispersants which may be grafted with maleic anhydride. A more complete list of nitrogen-containing compounds that can be reacted with the functionalized OCP are described in U.S. Pat. Nos. 7,485,603; 7,786,057; 7,253,231; 6,107,257; and 5,075,383; and/or are commercially available.

One class of suitable dispersants may also be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may also be high molecular weight esters or half ester amides. A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference in their entireties.

In addition to the carbonate and boric acids post-treatments both the compounds may be post-treated, or further post-treatment, with a variety of post-treatments designed to improve or impart different properties. Such post-treatments include those summarized in columns 27-29 of U.S. Pat. No. 5,241,003, hereby incorporated by reference. Such treatments include, treatment with: Inorganic phosphorous acids or anhydrates (e.g., U.S. Pat. Nos. 3,403,102 and 4,648,980); Organic phosphorous compounds (e.g., U.S. Pat. No. 3,502,677); Phosphorous pentasulfides; Boron compounds as already noted above (e.g., U.S. Pat. Nos. 3,178,663 and 4,652,387); Carboxylic acid, polycarboxylic acids, anhydrides and/or acid halides (e.g., U.S. Pat. Nos. 3,708,522 and 4,948,386); Epoxides polyepoxiates or thioexpoxides (e.g., U.S. Pat. Nos. 3,859,318 and 5,026,495); Aldehyde or ketone (e.g., U.S. Pat. No. 3,458,530); Carbon disulfide (e.g., U.S. Pat. No. 3,256,185); Glycidol (e.g., U.S. Pat. No. 4,617,137); Urea, thiourea or guanidine (e.g., U.S. Pat. Nos. 3,312,619; 3,865,813; and British Patent GB 1,065,595); Organic sulfonic acid (e.g., U.S. Pat. No. 3,189,544 and British Patent GB 2,140,811); Alkenyl cyanide (e.g., U.S. Pat. Nos. 3,278,550 and 3,366,569); Diketene (e.g., U.S. Pat. No. 3,546,243); A diisocyanate (e.g., U.S. Pat. No. 3,573,205); Alkane sultone (e.g., U.S. Pat. No. 3,749,695); 1,3-Dicarbonyl Compound (e.g., U.S. Pat. No. 4,579,675); Sulfate of alkoxylated alcohol or phenol (e.g., U.S. Pat. No. 3,954,639); Cyclic lactone (e.g., U.S. Pat. Nos. 4,617,138; 4,645,515; 4,668,246; 4,963,275; and 4,971,711); Cyclic carbonate or thiocarbonate linear monocarbonate or polycarbonate, or chloroformate (e.g., U.S. Pat. Nos. 4,612,132; 4,647,390; 4,648,886; 4,670,170); Nitrogen-containing carboxylic acid (e.g., U.S. Pat. No. 4,971,598 and British Patent GB 2,140,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603 and 4,666,460); Cyclic carbonate or thiocarbonate, linear monocarbonate or polycarbonate, or chloroformate (e.g., U.S. Pat. Nos. 4,612,132; 4,647,390; 4,646,860; and 4,670,170); Nitrogen-containing carboxylic acid (e.g., U.S. Pat. No. 4,971,598 and British Patent GB 2,440,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603, and 4,666,460); Cyclic carbamate, cyclic thiocarbamate or cyclic dithiocarbamate (e.g., U.S. Pat. Nos. 4,663,062 and 4,666,459); Hydroxyaliphatic carboxylic acid (e.g., U.S. Pat. Nos. 4,482,464; 4,521,318; 4,713,189); Oxidizing agent (e.g., U.S. Pat. No. 4,379,064); Combination of phosphorus pentasulfide and a polyalkylene polyamine (e.g., U.S. Pat. No. 3,185,647); Combination of carboxylic acid or an aldehyde or ketone and sulfur or sulfur chloride (e.g., U.S. Pat. Nos. 3,390,086; 3,470,098); Combination of a hydrazine and carbon disulfide (e.g. U.S. Pat. No. 3,519,564); Combination of an aldehyde and a phenol (e.g., U.S. Pat. Nos. 3,649,229; 5,030,249; 5,039,307); Combination of an aldehyde and an O-diester of dithiophosphoric acid (e.g., U.S. Pat. No. 3,865,740); Combination of a hydroxyaliphatic carboxylic acid and a boric acid (e.g., U.S. Pat. No. 4,554,086); Combination of a hydroxyaliphatic carboxylic acid, then formaldehyde and a phenol (e.g., U.S. Pat. No. 4,636,322); Combination of a hydroxyaliphatic carboxylic acid and then an aliphatic dicarboxylic acid (e.g., U.S. Pat. No. 4,663,064); Combination of formaldehyde and a phenol and then glycolic acid (e.g., U.S. Pat. No. 4,699,724); Combination of a hydroxyaliphatic carboxylic acid or oxalic acid and then a diisocyanate (e.g. U.S. Pat. No. 4,713,191); Combination of inorganic acid or anhydride of phosphorus or a partial or total sulfur analog thereof and a boron compound (e.g., U.S. Pat. No. 4,857,214); Combination of an organic diacid then an unsaturated fatty acid and then a nitrosoaromatic amine optionally followed by a boron compound and then a glycolating agent (e.g., U.S. Pat. No. 4,973,412); Combination of an aldehyde and a triazole (e.g., U.S. Pat. No. 4,963,278); Combination of an aldehyde and a triazole then a boron compound (e.g., U.S. Pat. No. 4,981,492); Combination of cyclic lactone and a boron compound (e.g., U.S. Pat. Nos. 4,963,275 and 4,971,711). The above-mentioned patents are herein incorporated in their entireties.

The TBN of a suitable dispersant may be from about 10 to about 65 mg KOH/g dispersant, on an oil-free basis, which is comparable to about 5 to about 30 TBN if measured on a dispersant sample containing about 50% diluent oil. TBN is measured by the method of ASTM D2896.

In yet other embodiments, the optional dispersant additive may be a hydrocarbyl substituted succinamide or succinimide dispersant. In approaches, the hydrocarbyl substituted succinamide or succinimide dispersant may be derived from a hydrocarbyl substituted acylating agent reacted with a polyalkylene polyamine and wherein the hydrocarbyl substituent of the succinamide or the succinimide dispersant is a linear or branched hydrocarbyl group having a number average molecular weight of about 250 to about 5,000 as measured by GPC using polystyrene as a calibration reference.

In some approaches, the polyalkylene polyamine used to form the dispersant has the Formula

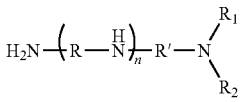

wherein each R and R', independently, is a divalent C1 to C6 alkylene linker, each $R_1$ and $R_2$, independently, is hydrogen, a C1 to C6 alkyl group, or together with the nitrogen atom to which they are attached form a 5- or 6-membered ring optionally fused with one or more aromatic or non-aromatic rings, and n is an integer from 0 to 8. In other approaches, the polyalkylene polyamine is selected from the group consisting of a mixture of polyethylene polyamines having an average of 5 to 7 nitrogen atoms, triethylenetetramine, tetraethylenepentamine, and combinations thereof.

The dispersant, if present, can be used in an amount sufficient to provide up to about 20 wt %, based upon the final weight of the lubricating oil composition. Another amount of the dispersant that can be used may be about 0.1 wt % to about 15 wt %, or about 0.1 wt % to about 10 wt %, about 0.1 to 8 wt %, or about 1 wt % to about 10 wt %, or about 1 wt % to about 8 wt %, or about 1 wt % to about 6 wt %, based upon the final weight of the lubricating oil composition. In some embodiments, the lubricating oil composition utilizes a mixed dispersant system. A single type or a mixture of two or more types of dispersants in any desired ratio may be used.

Antioxidants: The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox™ 4716 available from Albemarle Corporation.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight, based upon the final weight of the lubricating oil composition. In an embodiment, the antioxidant may be a mixture of about 0.3 to about 1.5% diarylamine and about 0.4 to about 2.5% high molecular weight phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

In another alternative embodiment the antioxidant composition also contains a molybdenum-containing antioxidant in addition to the phenolic and/or aminic antioxidants discussed above. When a combination of these three antioxidants is used, preferably the ratio of phenolic to aminic to molybdenum-containing component treat rates is (0 to 3):(0 to 3):(0 to 3).

The one or more antioxidant(s) may be present in ranges about 0 wt % to about 20 wt %, or about 0.1 wt % to about 10 wt %, or about 1 wt % to about 5 wt %, of the lubricating oil composition.

Antiwear Agents: The lubricating oil compositions herein also may optionally contain one or more antiwear agents. Examples of suitable antiwear agents include, but are not limited to, a metal thiophosphate; a metal dialkyldithiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl) disulfides; and mixtures thereof. A suitable antiwear agent may be a molybdenum dithiocarbamate. The phosphorus containing antiwear agents are more fully described in European Patent 612 839. The metal in the dialkyl dithio phosphate salts may be an alkali metal, alkaline earth metal, aluminum, lead, tin, molybdenum, manganese, nickel, copper, titanium, or zinc. A useful antiwear agent may be zinc dialkyldithiophosphate.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The tartrate or tartrimide may contain alkyl-ester groups, where the sum of carbon atoms on the alkyl groups may be at least 8. The antiwear agent may in one embodiment include a citrate.

The antiwear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Boron-Containing Compounds: The lubricating oil compositions herein may optionally contain one or more boron-containing compounds. Examples of boron-containing compounds include borate esters, borated fatty amines, borated epoxides, borated detergents, and borated dispersants, such as borated succinimide dispersants, as disclosed in U.S. Pat. No. 5,883,057. The boron-containing compound, if present, can be used in an amount sufficient to provide up to about 8 wt %, about 0.01 wt % to about 7 wt %, about 0.05 wt % to about 5 wt %, or about 0.1 wt % to about 3 wt % of the lubricating oil composition.

Detergents: The lubricating oil composition may optionally further comprise one or more neutral, low based, or overbased detergents, and mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein.

The detergent substrate may be salted with an alkali or alkaline earth metal such as, but not limited to, calcium, magnesium, potassium, sodium, lithium, barium, or mixtures thereof. In some embodiments, the detergent is free of barium. In some embodiments, a detergent may contain traces of other metals such as magnesium or calcium in amounts such as 50 ppm or less, 40 ppm or less, 30 ppm or less, 20 ppm or less, or 10 ppm or less. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

An overbased detergent of the lubricating oil composition may have a total base number (TBN) of about 200 mg KOH/g or greater, or as further examples, about 250 mg KOH/g or greater, or about 350 mg KOH/g or greater, or about 375 mg KOH/g or greater, or about 400 mg KOH/g or greater. The TBN being measured by the method of ASTM D2896.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased calcium phenate detergents have a total base number of at least about 150 mg KOH/g, at least about 225 mg KOH/g, at least about 225 mg KOH/g to about 400 mg KOH/g, at least about 225 mg KOH/g to about 350 mg KOH/g or about 230 mg KOH/g to about 350 mg KOH/g, all as measured by the method of ASTM D2896. When such detergent compositions are formed in an inert diluent, e.g. a process oil, usually a mineral oil, the total base number reflects the basicity of the overall composition including diluent, and any other materials (e.g., promoter, etc.) that may be contained in the detergent composition.

The overbased detergent may have a metal to substrate ratio of from 1.1:1, or from 2:1, or from 4:1, or from 5:1, or from 7:1, or from 10:1. In some embodiments, a detergent is effective at reducing or preventing rust in an engine or other automotive part such as a transmission or gear. The detergent may be present in a lubricating composition at about 0 wt % to about 10 wt %, or about 0.1 wt % to about 8 wt %, or about 1 wt % to about 4 wt %, or greater than about 4 wt % to about 8 wt %.

Extreme Pressure Agents: The lubricating oil compositions herein also may optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated wax; organic sulfides and polysulfides such as dibenzyldisulfide, bis(chlorobenzyl) disulfide, dibutyl tetrasulfide, sulfurized methyl ester of oleic acid, sulfurized alkyl phenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers: The lubricating oil compositions herein also may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685, herein incorporated by reference in its entirety.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference in its entirety.

A friction modifier may optionally be present in ranges such as about 0 wt % to about 10 wt %, or about 0.01 wt % to about 8 wt %, or about 0.1 wt % to about 4 wt %.

Molybdenum-containing component: The lubricating oil compositions herein also may optionally contain one or more molybdenum-containing compounds. An oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan® 822, Molyvan® A, Molyvan® 2000 and Molyvan® 855 from R. T. Vanderbilt Co., Ltd., and Adeka Sakura-Lube® S-165, S-200, S-300, S-310G, S-525, S-600, S-700, and S-710 available from Adeka Corporation, and mixtures thereof. Suitable molybdenum components are described in U.S. Pat. No. 5,650,381; RE 37,363 E1; RE 38,929 E1; and RE 40,595 E1, incorporated herein by reference in their entireties.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897, incorporated herein by reference in their entireties.

Another class of suitable organo-molybdenum compounds are trinuclear molybdenum compounds, such as those of the formula $Mo_3S_kL_nQ_z$ and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference in its entirety.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum.

Transition Metal-containing compounds: In another embodiment, the oil-soluble compound may be a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

In an embodiment, an oil-soluble transition metal-containing compound may function as antiwear agents, friction modifiers, antioxidants, deposit control additives, or more than one of these functions. In an embodiment the oil-soluble transition metal-containing compound may be an oil-soluble titanium compound, such as a titanium (IV) alkoxide. Among the titanium containing compounds that may be used in, or which may be used for preparation of the oils-soluble materials of, the disclosed technology are various Ti (IV) compounds such as titanium (IV) oxide; titanium (IV) sulfide; titanium (IV) nitrate; titanium (IV) alkoxides such as titanium methoxide, titanium ethoxide, titanium propoxide, titanium isopropoxide, titanium butoxide, titanium 2-ethylhexoxide; and other titanium compounds or complexes including but not limited to titanium phenates; titanium carboxylates such as titanium (IV) 2-ethyl-1-3-hexanedioate or titanium citrate or titanium oleate; and titanium (IV) (triethanolaminato) isopropoxide. Other forms of titanium encompassed within the disclosed technology include titanium phosphates such as titanium dithiophosphates (e.g., dialkyldithiophosphates) and titanium sulfonates (e.g., alkylbenzenesulfonates), or, generally, the reaction product of titanium compounds with various acid materials to form salts, such as oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In one embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl-(or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl-(or alkyl-) succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with about 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 grams+diluent oil) at 150° C. for 1.5 hours, to produce a titanium-modified succinimide dispersant.

Another titanium containing compound may be a reaction product of titanium alkoxide and $C_6$ to $C_{25}$ carboxylic acid. The reaction product may be represented by the following formula:

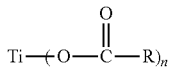

wherein n is an integer selected from 2, 3 and 4, and R is a hydrocarbyl group containing from about 5 to about 24 carbon atoms, or by the formula:

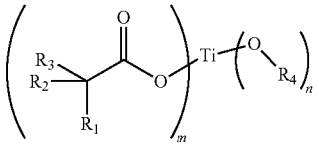

wherein m+n=4 and n ranges from 1 to 3, $R_4$ is an alkyl moiety with carbon atoms ranging from 1-8, $R_1$ is selected from a hydrocarbyl group containing from about 6 to 25 carbon atoms, and $R_2$ and $R_3$ are the same or different and are selected from a hydrocarbyl group containing from about 1 to 6 carbon atoms, or the titanium compound may be represented by the formula:

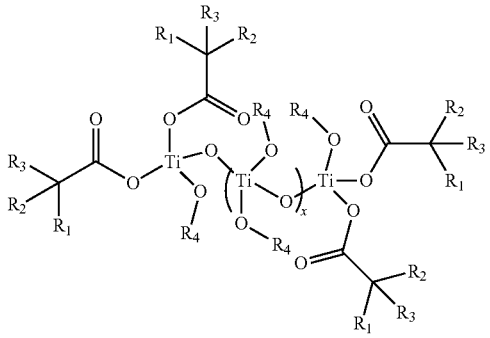

wherein x ranges from 0 to 3, $R_1$ is selected from a hydrocarbyl group containing from about 6 to 25 carbon atoms, $R_2$, and $R_3$ are the same or different and are selected from a hydrocarbyl group containing from about 1 to 6 carbon atoms, and $R_4$ is selected from a group consisting of either H, or $C_6$ to $C_{25}$ carboxylic acid moiety.

Suitable carboxylic acids may include, but are not limited to caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like.

In an embodiment the oil soluble titanium compound may be present in the lubricating oil composition in an amount to provide from 0 to 3000 ppm titanium by weight or 25 to about 1500 ppm titanium by weight or about 35 ppm to 500 ppm titanium by weight or about 50 ppm to about 300 ppm.

Viscosity Index Improvers: The lubricating oil compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 20 wt %, about 0.1 wt % to about 15 wt %, about 0.1 wt % to about 12 wt %, or about 0.5 wt % to about 10 wt %, of the lubricating oil composition.

Other Optional Additives: Other additives may be selected to perform one or more functions required of a lubricating fluid. Further, one or more of the mentioned additives may be multi-functional and provide functions in addition to or other than the function prescribed herein.

A lubricating oil composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid.

The rust inhibitor, if present, can be used in an amount sufficient to provide about 0 wt % to about 5 wt %, about 0.01 wt % to about 3 wt %, about 0.1 wt % to about 2 wt %, based upon the final weight of the lubricating oil composition.

In general terms, a suitable lubricant including the detergent metals herein may include additive components in the ranges listed in the following table.

TABLE 2a

Suitable Booster Additive Packages

| Component | Wt. % (Suitable Embodiments) | Wt. % (Suitable Embodiments) |
|---|---|---|
| Detergent | 1-10 | 1.5-8 |
| Dispersant | 0-20 | 2-18 |
| Antioxidant | 1-20 | 2-18 |
| Process Oil or Base oil | Balance | Balance |
| Total | 100 | 100 |

TABLE 2b

Suitable Finished Lubricating Compositions

| Component | Wt. % (Suitable Embodiments) | Wt. % (Suitable Embodiments) |
|---|---|---|
| Booster Additive Package | 0.5-2.0 | 0.8-1.8 |
| Detergent Systems | 0.02-5.0 | 0.2-2.0 |
| Dispersant Systems | 0-8.0 | 1-6.0 |
| Antioxidant(s) | 0.1-5.0 | 0.01-3.0 |
| Other Detergent(s) | 0.0-15.0 | 0.2-8.0 |
| Ashless TBN booster(s) | 0.0-1.0 | 0.01-0.5 |
| Corrosion inhibitor(s) | 0.0-5.0 | 0.0-2.0 |
| Metal dihydrocarbyldithiophosphate(s) | 0.0-6.0 | 0.1-4.0 |
| Ash-free phosphorus compound(s) | 0.0-6.0 | 0.0-4.0 |
| Antifoaming agent(s) | 0.0-5.0 | 0.001-0.15 |
| Antiwear agent(s) | 0.0-1.0 | 0.0-0.8 |
| Pour point depressant(s) | 0.0-5.0 | 0.01-1.5 |

TABLE 2b-continued

| Suitable Finished Lubricating Compositions | | |
|---|---|---|
| Component | Wt. % (Suitable Embodi-ments) | Wt. % (Suitable Embodi-ments) |
| Viscosity index improver(s) | 0.0-25.0 | 0.1-15.0 |
| Dispersant viscosity index improver(s) | 0.0-10.0 | 0.0-5.0 |
| Friction modifier(s) | 0.00-5.0 | 0.01-2.0 |
| Base oil | Balance | Balance |
| Total | 100 | 100 |

The percentages of each component above represent the weight percent of each component, based upon the weight of the final lubricating oil composition. The remainder of the lubricating oil composition consists of one or more base oils. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). Fully formulated lubricants conventionally contain an additive package, referred to herein as a dispersant/inhibitor package or DI package, that will supply the characteristics that are required in the formulation.

Definitions

For purposes of this disclosure, the chemical elements are identified in accordance with the Periodic Table of the Elements, CAS version, Handbook of Chemistry and Physics, 75th Ed. Additionally, general principles of organic chemistry are described in "Organic Chemistry", Thomas Sorrell, University Science Books, Sausolito: 1999, and "March's Advanced Organic Chemistry", 5th Ed., Ed.: Smith, M. B. and March, J., John Wiley & Sons, New York: 2001, the entire contents of which are hereby incorporated by reference.

As described herein, compounds may optionally be substituted with one or more substituents, such as are illustrated generally above, or as exemplified by particular classes, subclasses, and species of the disclosure.

Unless otherwise apparent from the context, the term "major amount" is understood to mean an amount greater than or equal to 50 weight percent, for example, from about 80 to about 98 weight percent relative to the total weight of the composition. Moreover, as used herein, the term "minor amount" is understood to mean an amount less than 50 weight percent relative to the total weight of the composition.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include: (1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical); (2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy); (3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein the term "aliphatic" encompasses the terms alkyl, alkenyl, alkynyl, each of which being optionally substituted as set forth below.

As used herein, an "alkyl" group refers to a saturated aliphatic hydrocarbon group containing 1-12 (e.g., 1-8, 1-6, or 1-4) carbon atoms. An alkyl group can be straight or branched. Examples of alkyl groups include, but are not limited to, methyl, ethyl, propyl, isopropyl, butyl, isobutyl, sec-butyl, tert-butyl, n-pentyl, n-heptyl, or 2-ethylhexyl. An alkyl group can be substituted (i.e., optionally substituted) with one or more substituents such as halo, phospho, cycloaliphatic [e.g., cycloalkyl or cycloalkenyl], heterocycloaliphatic [e.g., heterocycloalkyl or heterocycloalkenyl], aryl, heteroaryl, alkoxy, aroyl, heteroaroyl, acyl [e.g., (aliphatic) carbonyl, (cycloaliphatic) carbonyl, or (heterocycloaliphatic) carbonyl], nitro, cyano, amido [e.g., (cycloalkylalkyl) carbonylamino, arylcarbonylamino, aralkylcarbonylamino, (heterocycloalkyl) carbonylamino, (heterocycloalkylalkyl) carbonylamino, heteroarylcarbonylamino, heteroaralkyl carbonylamino alkylaminocarbonyl, cycloalkylaminocarbonyl, heterocycloalkylaminocarbonyl, arylaminocarbonyl, or heteroarylaminocarbonyl], amino [e.g., aliphaticamino, cycloaliphatic amino, or heterocycloaliphaticamino], sulfonyl [e.g., aliphatic-$SO_2$—], sulfinyl, sulfanyl, sulfoxy, urea, thiourea, sulfamoyl, sulfamide, oxo, carboxy, carbamoyl, cycloaliphaticoxy, heterocyclo aliphaticoxy, aryloxy, heteroaryloxy, aralkyloxy, heteroarylalkoxy, alkoxycarbonyl, alkyl carbonyloxy, or hydroxy. Without limitation, some examples of substituted alkyls include carboxyalkyl (such as HOOC-alkyl, alkoxycarbonylalkyl, and alkylcarbonyloxyalkyl), cyanoalkyl, hydroxyalkyl, alkoxyalkyl, acylalkyl, aralkyl, (alkoxyaryl) alkyl, (sulfonylamino) alkyl (such as (alkyl-$SO_2$-amino) alkyl), aminoalkyl, amidoalkyl, (cycloaliphatic)alkyl, or haloalkyl.

As used herein, an "alkenyl" group refers to an aliphatic carbon group that contains 2-8 (e.g., 2-12, 2-6, or 2-4) carbon atoms and at least one double bond. Like an alkyl group, an alkenyl group can be straight or branched. Examples of an alkenyl group include, but are not limited to allyl, isoprenyl, 2-butenyl, and 2-hexenyl. An alkenyl group can be optionally substituted with one or more substituents such as halo, phospho, cycloaliphatic [e.g., cycloalkyl or cycloalkenyl], heterocycloaliphatic [e.g., heterocycloalkyl or hetero cycloalkenyl], aryl, heteroaryl, alkoxy, aroyl, heteroaroyl, acyl [e.g., (aliphatic) carbonyl, (cycloaliphatic) carbonyl, or (heterocycloaliphatic) carbonyl], nitro, cyano, amido [e.g., (cycloalkylalkyl) carbonylamino, arylcarbonylamino, aralkylcarbonylamino, (hetero cycloalkyl) carbonylamino, (heterocyclo alkylalkyl) carbonylamino, heteroarylcarbonylamino, heteroaralkylcarbonylamino alkylamino carbonyl, cycloalkylaminocarbonyl, hetero cyclo alkylaminocarbonyl, arylaminocarbonyl, or heteroarylaminocarbonyl], amino [e.g., aliphaticamino, cycloaliphaticamino, heterocyclo aliphaticamino, or aliphaticsulfonylamino], sulfonyl [e.g., alkyl-$SO_2$—, cycloaliphatic-$SO_2$—, or aryl-$SO_2$—], sulfinyl, sulfanyl, sulfoxy, urea, thiourca, sulfamoyl, sulfamide, oxo, carboxy, carbamoyl, cycloaliphaticoxy, heterocycloaliphaticoxy, aryloxy, heteroaryloxy, aralkyloxy, heteroaralkoxy, alkoxycarbonyl, alkylcarbonyloxy, or hydroxy. Without limitation, some examples of substituted alkenyls include cyanoalkenyl, alkoxyalkenyl, acylalkenyl, hydroxyl alkenyl, aralkenyl, (alkoxyaryl) alkenyl, (sulfonylamino)alkenyl (such as (alkyl-$SO_2$-amino) alkenyl), aminoalkenyl, amidoalkenyl, (cycloaliphatic)alkenyl, or haloalkenyl.

As used herein, an "alkynyl" group refers to an aliphatic carbon group that contains 2-8 (e.g., 2-12, 2-6, or 2-4) carbon atoms and has at least one triple bond. An alkynyl group can be straight or branched. Examples of an alkynyl group include, but are not limited to, propargyl and butynyl. An alkynyl group can be optionally substituted with one or more substituents such as aroyl, heteroaroyl, alkoxy, cycloalkyloxy, heterocycloalkyloxy, aryloxy, heteroaryloxy, aralkyl oxy, nitro, carboxy, cyano, halo, hydroxy, sulfo, mercapto, sulfanyl [e.g., aliphaticsulfanyl or cycloaliphaticsulfanyl], sulfinyl [e.g., aliphaticsulfinyl or cycloaliphaticsulfinyl], sulfonyl [e.g., aliphatic-$SO_2$—, aliphaticamino-$SO_2$—, or cycloaliphatic-$SO_2$—], amido [e.g., aminocarbonyl, alkylaminocarbonyl, alkylcarbonylamino, cyclo alkylaminocarbonyl, heterocycloalkylaminocarbonyl, cycloalkylcarbonylamino, arylamino carbonyl, arylcarbonylamino, aralkylcarbonylamino, (heterocycloalkyl) carbonylamino, (cycloalkylalkyl) carbonylamino, heteroaralkylcarbonylamino, heteroaryl carbonylamino or heteroaryl amino carbonyl], urea, thiourca, sulfamoyl, sulfamide, alkoxycarbonyl, alkyl carbonyloxy, cyclo aliphatic, heterocycloaliphatic, aryl, heteroaryl, acyl [e.g., (cycloaliphatic) carbonyl or (hetero cyclo aliphatic) carbonyl], amino [e.g., aliphaticamino], sulfoxy, oxo, carboxy, carbamoyl, (cycloaliphatic)oxy, (heterocyclo aliphatic) oxy, or (heteroaryl) alkoxy.

As used herein, an "amino" group refers to —$NR^XR^Y$ wherein each of $R^X$ and $R^Y$ is independently hydrogen, alkyl, cycloakyl, (cycloalkyl)alkyl, aryl, aralkyl, heterocycloalkyl, (heterocycloalkyl)alkyl, heteroaryl, carboxy, sulfanyl, sulfinyl, sulfonyl, (alkyl) carbonyl, (cycloalkyl) carbonyl, ((cycloalkyl)alkyl) carbonyl, arylcarbonyl, (aralkyl) carbonyl, (heterocyclo alkyl) carbonyl, ((heterocycloalkyl)alkyl) carbonyl, (heteroaryl) carbonyl, or (heteroaralkyl) carbonyl, each of which being defined herein and being optionally substituted. Examples of amino groups include alkylamino, dialkylamino, or arylamino. When the term "amino" is not the terminal group (e.g., alkylcarbonylamino), it is represented by —$NR^X$—. $R^X$ has the same meaning as defined above.

As used herein, a "cycloalkyl" group refers to a saturated carbocyclic mono- or bicyclic (fused or bridged) ring of 3-10 (e.g., 5-10) carbon atoms. Examples of cycloalkyl groups include cyclopropyl, cyclobutyl, cyclopentyl, cyclohexyl, cycloheptyl, adamantyl, norbornyl, cubyl, octahydroindenyl, decahydro-naphthyl, bicyclo[3.2.1]octyl, bicyclo[2.2.2]octyl, bicyclo[3.3.1]nonyl, bicyclo[3.3.2.]decyl, bicyclo[2.2.2]octyl, adamantyl, or ((aminocarbonyl)cycloalkyl)cycloalkyl.

As used herein, a "heterocycloalkyl" group refers to a 3-10 membered mono- or bicylic (fused or bridged) (e.g., 5- to 10-membered mono- or bicyclic) saturated ring structure, in which one or more of the ring atoms is a heteroatom (e.g., N, O, S, or combinations thereof). Examples of a heterocycloalkyl group include piperidyl, piperazyl, tetrahydropyranyl, tetrahydrofuryl, 1,4-dioxolanyl, 1,4-dithianyl, 1,3-dioxolanyl, oxazolidyl, isoxazolidyl, morpholinyl, thiomorpholyl, octahydrobenzofuryl, octahydrochromenyl, octahydrothio chromenyl, octahydroindolyl, octahydropyrindinyl, decahydroquinolinyl, octahydrobenzo[b]thiophencyl, 2-oxa-bicyclo[2.2.2]octyl, 1-aza-bicyclo[2.2.2]octyl, 3-aza-bicyclo[3.2.1]octyl, and 2,6-dioxa-tricyclo[3.3.1.0]nonyl. A monocyclic heterocycloalkyl group can be fused with a phenyl moiety to form structures, such as tetrahydroisoquinoline, which would be categorized as heteroaryls.

A "heteroaryl" group, as used herein, refers to a monocyclic, bicyclic, or tricyclic ring system having 4 to 15 ring atoms wherein one or more of the ring atoms is a heteroatom (e.g., N, O, S, or combinations thereof) and in which the monocyclic ring system is aromatic or at least one of the rings in the bicyclic or tricyclic ring systems is aromatic. A heteroaryl group includes a benzofused ring system having 2 to 3 rings. For example, a benzofused group includes benzo fused with one or two 4 to 8 membered heterocycloaliphatic moieties (e.g., indolizyl, indolyl, isoindolyl, 3H-indolyl, indolinyl, benzo[b]furyl, benzo[b]thiophenyl, quinolinyl, or isoquinolinyl). Some examples of heteroaryl are pyridyl, 1H-indazolyl, furyl, pyrrolyl, thienyl, thiazolyl, oxazolyl, imidazolyl, tetrazolyl, benzofuryl, isoquinolinyl, benzthiazolyl, xanthene, thioxanthene, phenothiazine, dihydroindole, benzo[1,3]dioxole, benzo[b]furyl, benzo[b]thiophenyl, indazolyl, benzimidazolyl, benzthiazolyl, puryl, cinnolyl, quinolyl, quinazolyl, cinnolyl, phthalazyl, quinazolyl, quinoxalyl, isoquinolyl, 4H-quinolizyl, benzo-1,2,5-thiadiazolyl, or 1,8-naphthyridyl.

Without limitation, monocyclic heteroaryls include furyl, thiophenyl, 2H-pyrrolyl, pyrrolyl, oxazolyl, thazolyl, imidazolyl, pyrazolyl, isoxazolyl, isothiazolyl, 1,3,4-thiadiazolyl, 2H-pyranyl, 4-H-pranyl, pyridyl, pyridazyl, pyrimidyl, pyrazolyl, pyrazyl, or 1,3,5-triazyl. Monocyclic heteroaryls are numbered according to standard chemical nomenclature.

Without limitation, bicyclic heteroaryls include indolizyl, indolyl, isoindolyl, 3H-indolyl, indolinyl, benzo[b]furyl, benzo[b]thiophenyl, quinolinyl, isoquinolinyl, indolizinyl, isoindolyl, indolyl, benzo[b]furyl, bexo[b]thiophenyl, indazolyl, benzimidazyl, benzthiazolyl, purinyl, 4H-quinolizyl, quinolyl, isoquinolyl, cinnolyl, phthalazyl, quinazolyl, quinoxalyl, 1,8-naphthyridyl, or pteridyl. Bicyclic heteroaryls are numbered according to standard chemical nomenclature.

As used herein, the term "treat rate" refers to the weight percent of a component in the finished lubricant, the passenger car motor oil, and/or the booster.

The weight average molecular weight (Mw) and the number average molecular weight (Mn) may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 1.0 ml/min. The GPC instrument may be calibrated with commercially available poly(methyl methacrylate) (PMMA) standards having a narrow molecular weight distribution ranging from 960-1,568,000 g/mol. The calibration curve can be extrapolated for samples having a mass less than 500 g/mol. Samples and PMMA standards can be in dissolved in THF and prepared at concentration of 0.1 to 0.5 wt. % and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

EXAMPLES

A better understanding of the present disclosure and its many advantages may be clarified with the following examples. The following examples are illustrative and not limiting thereof in either scope or spirit. Those skilled in the art will readily understand that variations of the components, methods, steps, and devices described in these examples can be used. Unless noted otherwise or apparent from the context of discussion in the Examples below and throughout this disclosure, all percentages, ratios, and parts noted in this disclosure are by weight.

Example 1

Baseline comparative (unboosted) and inventive finished lubricating compositions (e.g., a passenger car motor oil plus booster) were evaluated for rust protection pursuant to ASTM D6557. The evaluation entailed a 2017 Ford F150 with a 3.5 L Ecoboost V6 driving using a Quad 4 drive cycle (SAE 2017-01-2298) for 6000 total miles. Oil was sampled every 600 miles and evaluated using the Ball Rust Test of ASTM D6557. A baseline, comparative lubricant comprising a GF-6 lubricant was compared to the inventive finished lubricating including the baseline lubricant including a booster additive packing providing an additional 0.2 weight percent of an aminic antioxidant (di-nonyl diphenylamine) and an additional 0.1 weight percent of an overbased (400 TBN) magnesium sulfonate detergent.

Ball rust test results are provided in FIG. 1 showing the inventive boosted lubricant (circles) provide a higher initial rust protection and a higher level of protection over the 6000 mile evaluation with used lubricant as compared to the untreated GF-6 baseline lubricant (diamonds).

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A method for providing rust protection to a valve train component of a passenger car engine with a lubricating composition, the method comprising providing fresh or used API SP and/or GF-6 licensable passenger car motor oil lubricating composition including (i) one or more base oils of lubricating viscosity; (ii) a dispersant inhibitor additive package including dispersant, antiwear, friction modifier, or combinations thereof; and (iii) optionally, a viscosity index improver and including one or more detergent additives providing soap and up to about 0.5 weight percent soap to the API SP and/or GF-6 licensable passenger car motor oil lubricating composition and one or more oil-soluble nitrogen containing compounds providing nitrogen and up to about 600 ppm dispersant nitrogen to the API SP and/or GF-6 licensable passenger car motor oil lubricating composition;

adding a top-treat booster additive package to the fresh or used API SP and/or GF-6 licensable passenger car motor oil lubricating composition to form the lubricating composition, and wherein the combination of the fresh or used API SP and/or GF-6 passenger car motor oil lubricating composition and the top-treat booster additive package remain licensable with the American Petroleum Institute (API) and/or the International Lubricant Standardization and Approval committee (ILSAC);

wherein the top-treat booster additive package is free of zinc dialkyldithiophosphate antiwear additives and includes one or more oil soluble nitrogen-containing compounds providing about 1000 ppm to about 8500 ppm of nitrogen to the top-treat booster additive package; one or more detergent additives providing about 0.2 weight percent to about 5 weight percent soap to the top-treat booster additive package, and wherein the one or more detergent additives contribute about 100 ppm of magnesium per ounce of the top-treat additive package to about 5000 ppm of magnesium per ounce of the top-treat additive package; wherein the top-treat booster additive package is configured, upon addition to an API SP and/or GF-6 licensable fresh and/or used passenger car motor oil composition, to maintain API SP and/or GF-6 licensing; and wherein, when the top-treat booster additive package is added to the API SP and/or GF-6 licensable passenger car motor oil lubricating composition, the combination of the API SP and/or GF-6 licensable passenger car motor oil lubricating composition and the top-treat booster additive package remain licensable with the American Petroleum Institute (API) and/or the International Lubricant Standardization and Approval committee (ILSAC); and wherein the lubricating composition exhibits a higher rust protection for up to about 6000 miles of lubrication when measured pursuant to ASTM D6557 as compared to a baseline lubricating composition with the API SP and/or GF-6 licensable passenger car motor oil composition but without the top-treat booster additive package.

2. The method for providing rust protection of claim 1, wherein the top-treat booster additive package includes one or more oil soluble nitrogen-containing compounds providing about 1000 ppm to about 8500 ppm of nitrogen to the top-treat booster additive package; one or more detergent additives providing about 0.2 weight percent to about 5 weight percent soap to the top-treat booster additive package.

3. The method for providing rust protection of claim 1, wherein the top-treat booster additive package is added to the fresh or used API SP and/or GF-6 passenger car motor oil lubricating composition in an amount effective to provide one or more of (a) increasing the total nitrogen content by at least about 5% relative to the API SP and/or GF-6 licensable passenger car motor oil lubricating composition; (b) increasing the magnesium content by at least about 20% relative to the API SP and/or GF-6 licensable passenger car motor oil lubricating composition; (c) increasing the magnesium soap content by at least about 20% relative to the API SP and/or GF-6 licensable passenger car motor oil lubricating composition; or (d) combination thereof.

4. The method of claim 1, wherein at least about 90 weight percent of the detergent soap in the top-treat booster additive package is provided by the one or more detergent additives in the top-treat booster additive package having a total base number (TBN) of about 250 mg KOH/g or more.

5. The method of claim 4, wherein the one or more detergent additives in the top-treat booster additive package include only a magnesium-containing detergent additive.

6. The method of claim 1, wherein the one or more detergent additives in the top-treat booster additive package contribute a total base number (TBN) to the top-treat booster additive package of about 5 mg KOH/g to about 40 mg KOH/g as measured pursuant to ASTM D2896, and/or wherein a TBN/ounce of the booster additive package is about 0.5 to about 16 mg KOH/g per ounce of the top-treat booster additive package.

7. The method of claim 6, wherein about 65 to about 100 percent of the detergent TBN in the top-treat booster additive package is provided by one or more magnesium-containing detergent additives.

8. The method of claim 7, wherein the top-treat booster additive package includes about 1000 ppm to about 10,000 ppm of magnesium from a magnesium-containing detergent.

9. The method of claim 1, wherein the oil soluble nitrogen-containing in the top-treat booster additive package compound incudes an aminic antioxidant.

10. The method of claim 9, wherein the oil soluble nitrogen-containing compound in the top-treat booster additive package is an aminic antioxidant selected from the group comprising aromatic amines, alkylated diphenyl amines, di-alkyl diphenylamine, phenyl-alpha-naphthylamines, alkylated phenyl-alpha-naphthylamines, hindered non-aromatic amines, or combinations thereof.

11. The method of claim 1, wherein the top-treat booster additive package includes one or more aminic antioxidants providing about 1000 ppm to about 6000 ppm of antioxidant nitrogen and/or wherein the top-treat booster additive package has about 100 ppm of antioxidant nitrogen per ounce of the top-treat booster additive package to about 3000 ppm of antioxidant nitrogen per ounce of the top-treat booster additive package.

12. The method of claim 1, wherein a ratio of detergent total base number (TBN) to detergent total soap content in the top-treat booster additive package is about 10:1 to about 15:1.

13. The method of claim 1, wherein about 90 to about 100 percent of the nitrogen in the top-treat booster additive package is provided by an aminic antioxidant.

14. The method of claim 9, wherein the top-treat booster additive package further includes one or more ashless dispersants obtainable by reacting a hydrocarbyl substituted acylating agent with a nitrogen source.

15. The method of claim 14, wherein the ashless dispersant in the top-treat booster additive package is post-treated with one or more of boron, carboxylic acids or derivatives thereof, and combinations thereof.

16. The method claim 14, wherein the top-treat booster additive package includes about 400 to about 2500 ppm of dispersant nitrogen provided by the one or more ashless dispersants and/or wherein the top-treat booster additive package includes about 40 ppm of dispersant nitrogen per ounce of the top-treat booster additive package to about 1300 ppm of dispersant nitrogen per ounce of the top-treat booster additive package.

17. The method of claim 1, wherein the top-treat booster additive package further includes a calcium-containing detergent additive.

18. The method of claim 17, wherein the top-treat booster additive package further includes about 900 ppm to about 5,000 ppm of calcium from the calcium-containing detergent additive and/or wherein the top-treat booster additive package includes about 90 ppm of detergent calcium per ounce of the top-treat booster additive package to about 2,500 ppm of detergent calcium per ounce of the top-treat booster additive package.

19. The method of claim 1, wherein the lubricating composition has at least one of (a) about 450 ppm to about 550 ppm of magnesium provided from the API SP and/or GF-6 licensable passenger car motor oil lubricating composition and the top-treat booster additive package combined; (b) about 700 to about 1200 ppm of total nitrogen provided from the API SP and/or GF-6 licensable passenger car motor oil lubricating composition and the top-treat booster additive package combined; (c) about 0.5 to about 1.0 weight percent of soap content from the API SP and/or GF-6 licensable passenger car motor oil lubricating composition and the top-treat booster additive package combined; or (d) combination thereof.

20. The method of claim 1, wherein the lubricating composition includes about 1 to about 10 weight percent of the top-treat booster additive package.

* * * * *